US009756409B2

(12) United States Patent
Hofmann

(10) Patent No.: US 9,756,409 B2
(45) Date of Patent: Sep. 5, 2017

(54) LOUDSPEAKER COVER

(71) Applicant: Dr. Ing. h.c. F. Porsche Aktiengesellschaft, Stuttgart (DE)

(72) Inventor: Peter Hofmann, Neuhausen (DE)

(73) Assignee: DR. ING. H.C.F. PORSCHE AKTIENGESELLSCHAFT, Stuttgart (DE)

( * ) Notice: Subject to any disclaimer, the term of this patent is extended or adjusted under 35 U.S.C. 154(b) by 112 days.

(21) Appl. No.: 14/854,148

(22) Filed: Sep. 15, 2015

(65) Prior Publication Data

US 2016/0080847 A1 Mar. 17, 2016

(30) Foreign Application Priority Data

Sep. 17, 2014 (DE) ..... 10 2014 113 355

(51) Int. Cl.
*F21V 33/00* (2006.01)
*H04R 1/02* (2006.01)

(52) U.S. Cl.
CPC ..... *H04R 1/028* (2013.01); *F21V 33/0056* (2013.01); *H04R 2499/13* (2013.01)

(58) Field of Classification Search
CPC ..... F21V 33/0056
USPC ..... 362/86, 501
See application file for complete search history.

(56) References Cited

U.S. PATENT DOCUMENTS 4,546,850 A * 10/1985 Litner ..... H04R 1/023 181/141
6,000,493 A * 12/1999 Chen ..... H04R 1/028 181/141
6,270,229 B1 * 8/2001 Chien ..... F21S 10/00 362/84
6,978,031 B2 * 12/2005 Garretson ..... H04R 1/023 381/162

(Continued)

FOREIGN PATENT DOCUMENTS

DE 20 2006 015 232 12/2006
DE 10 2010 005 326 7/2011

(Continued)

OTHER PUBLICATIONS

German Search Report.
English Translation of Korean Office Action Dated Nov. 25, 2016.

*Primary Examiner* — Julie Bannan
(74) *Attorney, Agent, or Firm* — Gerald E. Hespos; Michael J. Porco; Matthew T. Hespos

(57) ABSTRACT

A loudspeaker cover (1) has a carrier frame (2) and a sound-permeable loudspeaker covering panel (3) attached to the carrier frame (2). A light exit opening (7) is formed between the loudspeaker covering panel (3) and the carrier frame (2). A lighting device (4) having at least one light-guide (40) and at least one lighting unit are arranged so that, during operation, light can be input into the lightguide (40). The lightguide (40) is arranged between the carrier frame (2) and the loudspeaker covering panel (3) and extends in the circumferential direction of the carrier frame (2). As a result, (Continued)

at least a portion of the light exiting a lateral surface of the lightguide (40) can propagate into the surroundings through the light exit opening (7). The carrier frame (2) is connected at least in certain sections in a materially joined fashion to the loudspeaker covering panel (3).

16 Claims, 3 Drawing Sheets

(56) References Cited

U.S. PATENT DOCUMENTS

| | | | | |
|---|---|---|---|---|
| 7,878,673 | B2 * | 2/2011 | Kempkey | F21V 33/0056 362/101 |
| 2004/0175014 | A1 * | 9/2004 | Liu | H04R 1/028 381/386 |
| 2005/0002199 | A1 * | 1/2005 | Stuffle | B60Q 3/20 362/487 |
| 2007/0223770 | A1 * | 9/2007 | Fujisawa | F21V 33/0056 381/396 |
| 2008/0310668 | A1 * | 12/2008 | Koch | B60R 11/0217 381/389 |
| 2009/0284974 | A1 | 11/2009 | Kempkey et al. | |
| 2011/0080733 | A1 * | 4/2011 | Wang | F21V 21/04 362/253 |
| 2011/0181066 | A1 | 7/2011 | Pandura et al. | |
| 2011/0235845 | A1 * | 9/2011 | Wang | H04R 1/26 381/386 |
| 2011/0317861 | A1 * | 12/2011 | Haase | F21V 33/0056 381/333 |
| 2012/0008323 | A1 * | 1/2012 | Lazzeroni | H04R 1/028 362/253 |

FOREIGN PATENT DOCUMENTS

| | | | |
|---|---|---|---|
| DE | 10 2012 005 706 | | 9/2013 |
| JP | H1018183 | A | 1/1999 |
| JP | 2011240811 | A | 12/2011 |
| KR | 200469049 | Y1 | 9/2013 |
| WO | 2011/010187 | | 1/2011 |

* cited by examiner

LOUDSPEAKER COVER

CROSS REFERENCE TO RELATED APPLICATION

This application claims priority under 35 USC 119 to German Patent Appl. No. 10 2014 113 355.2 filed on Sep. 17, 2014, the entire disclosure of which is incorporated herein by reference.

BACKGROUND

1. Field of the Invention

The invention relates to loudspeaker cover, comprising a carrier frame, a sound-permeable loudspeaker covering panel attached to the carrier frame, a light exit opening between the loudspeaker covering panel and the carrier frame, and a lighting device having at least one lightguide means and at least one lighting unit arranged so that during operation light can be input into the lightguide. The lightguide is arranged between the carrier frame and the loudspeaker covering panel and extends in the circumferential direction of the carrier frame. As a result, at least a portion of the light exiting a lateral surface of the lightguide can propagate into the surroundings through the light exit opening.

2. Description of the Related Art

Loudspeaker covers of the type described above can be used for covering a loudspeaker in a recess of an internal trim, such as a door trim of a motor vehicle. The lighting device functions for visually accentuating the loudspeaker cover or the region of the passenger compartment trim adjoining the loudspeaker cover in a targeted fashion to provide a high-quality visual appearance.

DE 10 2012 005 706 A1 discloses an example of a loudspeaker arrangement for a motor vehicle having a loudspeaker cover and a lighting device with a lightguide.

The invention provides a loudspeaker cover of the type described above that can be mounted in a particularly easy way.

SUMMARY

The invention relates to a loudspeaker cover that has a carrier frame connected at least in certain sections in a materially joined fashion to a loudspeaker covering panel. A lightguide of a lighting device is arranged between the carrier frame and the loudspeaker covering panel of the loudspeaker cover to define a one-piece assembly that can be premounted. More particularly, the loudspeaker cover can be mounted during final assembly with few manual operations, for example, in the region of a cutout in a passenger compartment trim of a motor vehicle, such as a door trim, or on a loudspeaker housing. The lighting device can be operative to emit light of a single color during operation. Alternatively, the lighting unit can be operative to emit light of different colors that can be adjusted in a user-defined fashion. The lighting unit may comprise at least one light emitting diode as a lighting means. The lighting device may have at least two lighting units arranged essentially opposite one another so that light can be input into the lightguide at two different positions to achieve a more uniform illumination.

The carrier frame may be welded at least in certain sections to the loudspeaker covering panel. Punctiform or planer welded connections between the carrier frame and the loudspeaker covering panel can be manufactured very easily in terms of manufacturing technology and with high precision.

Alternatively, the carrier frame may be bonded at least in certain sections to the loudspeaker covering panel. Bonded connections can be manufactured very easily during the manufacture of the loudspeaker covering panel.

The carrier frame can be shaped to be attached to a loudspeaker housing or in a recess corresponding to the carrier frame, in a passenger compartment trim of a motor vehicle, such as a door trim.

The carrier frame may have plural attachments configured so that the carrier frame can be attached in a frictionally locking fashion to the passenger compartment trim or to the loudspeaker housing. As a result, the attachment of the carrier frame to the passenger compartment trim or to the loudspeaker housing is selectively releasable.

The lighting device may comprise a reflector to improve the optical irradiation characteristic of the lighting device. The reflector may be arranged so that light exiting the lateral surface of the lightguide can be reflected by the reflector at least partially through the light exit opening into the surroundings.

The reflector can comprise a securing section that extends at least in certain sections between the carrier frame and the loudspeaker covering panel. In this embodiment, the reflector may be a component of the one-piece assembly and therefore advantageously does not have to be mounted and adjusted in an additional mounting step.

The reflector may comprise a reflection surface that extends at least in certain sections into the light exit opening to improve exiting of light from the light exit opening of the loudspeaker cover. The reflection surface may be parabolic at least in certain sections and may have a focal point in the region of the light exit opening. The reflection surface can have a reflection coating that can be obtained by electroplating.

The lighting device may have a diffuser that extends at least in certain sections around the lightguide and can scatter diffusely at least a portion of the light exiting the lightguide to obtain an optical irradiation characteristic that is experienced as softer by a viewer. In other words, at least a portion of the light from the diffuser is scattered diffusely before it is reflected at the reflection surface of the reflector means.

The diffuser may be connected in a materially joined fashion to the carrier frame and can be welded or bonded to the carrier frame. The diffuser is therefore also a component of the one-piece assembly in this embodiment, with the advantage that it does not have to be mounted in a costly fashion in an additional mounting step.

Further features and advantages of the invention become clear by the following description of a preferred exemplary embodiment with reference to the drawings.

DETAILED DESCRIPTION

Figure 1:
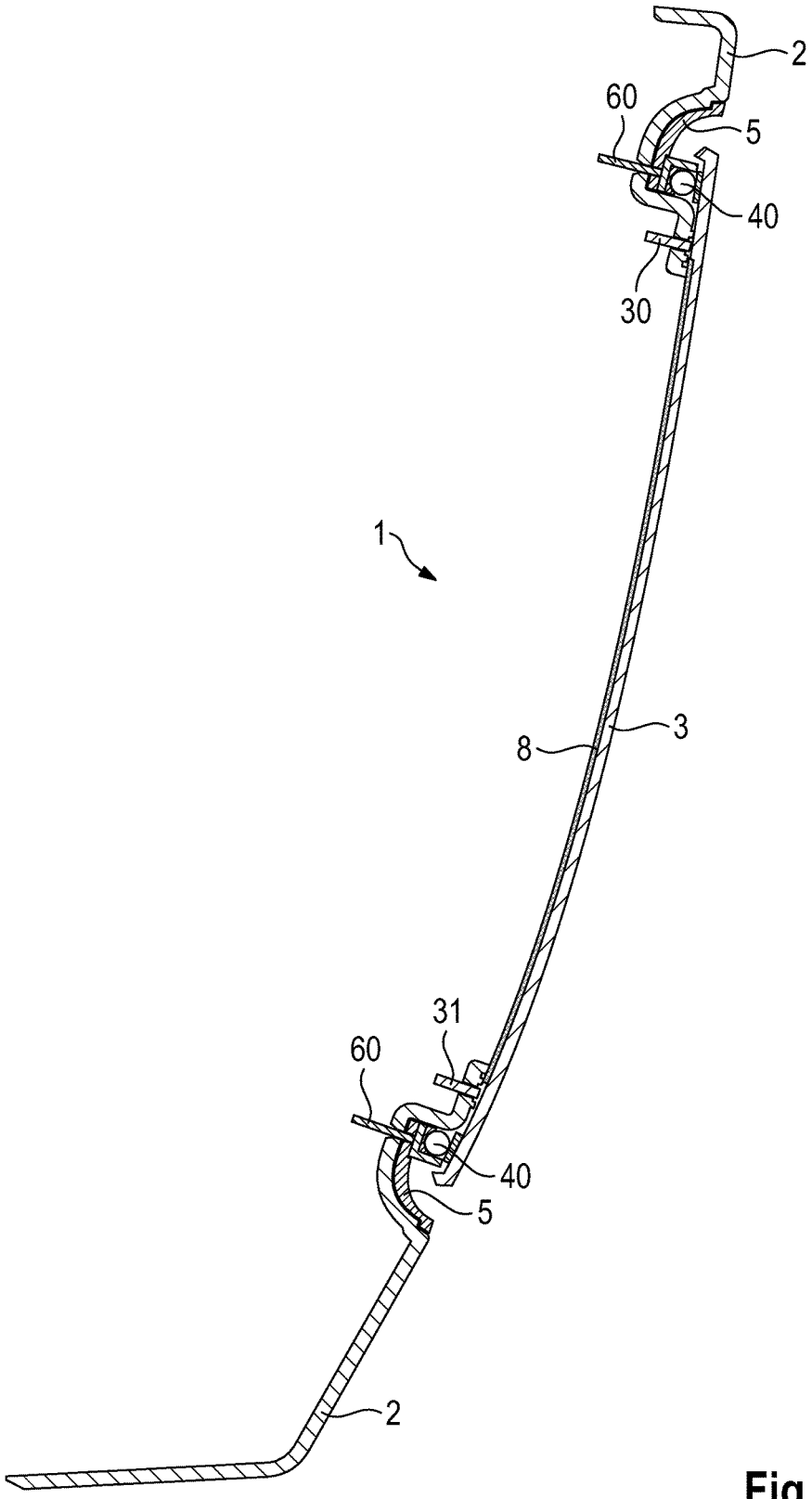
FIG. 1 shows a longitudinal section through a loudspeaker cover which is embodied according to a first exemplary embodiment of the present invention.
Figure 2:
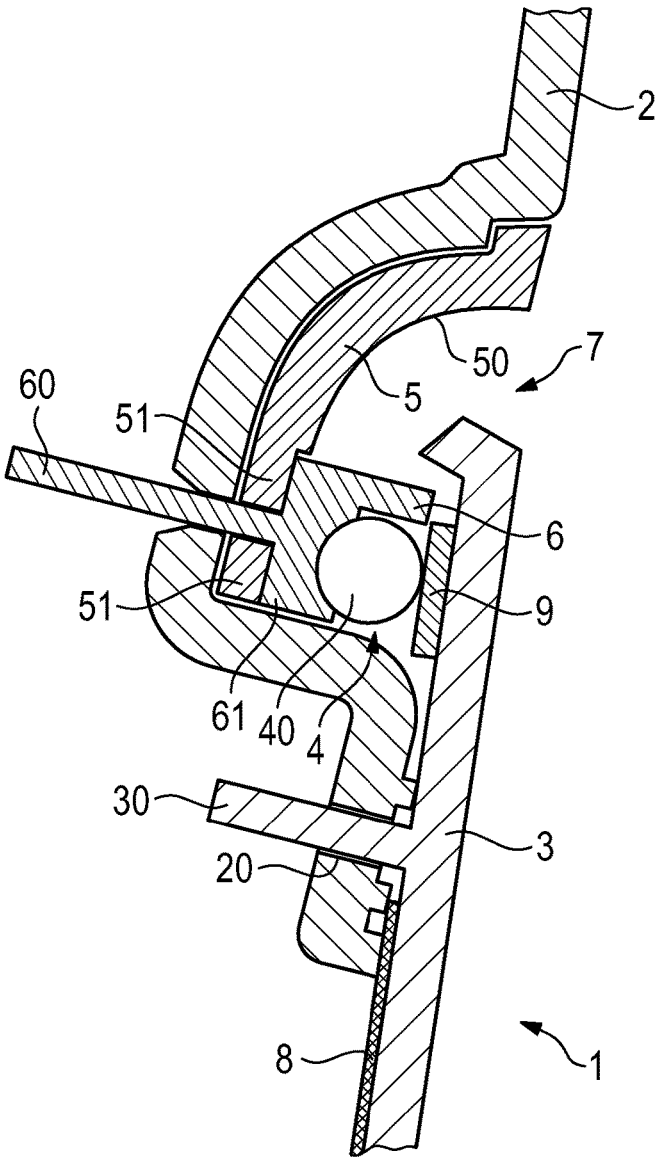
FIG. 2 shows an enlarged illustration of a detail according to II in FIG. 1.

With reference to FIGS. 1 and 2, a loudspeaker cover 1 of a first embodiment of the invention comprises a carrier frame 2 as well as a loudspeaker covering panel 3 which is permeable to sound at least in certain sections and is attached to the carrier frame 2. The carrier frame 2 is shaped in such a way that it can be suitably inserted into a cutout in a passenger compartment trim of a motor vehicle, in particular into a cutout of a door trim. In addition, the loudspeaker cover 1 comprises a lighting device 4 which is embodied in such a way that in the actuated state it can generate accent lighting for the loudspeaker cover 1 and nearby regions of the passenger compartment trim.

The loudspeaker covering panel 3 which is permeable to sound at least in certain sections can, for example, be a plastic grille or a metal screen (for example an aluminum screen) which is perforated at least in certain sections, or at least comprise a plastic grille or at least one metal screen which is perforated at least in certain sections. The loudspeaker covering panel 3 is preferably—as illustrated in this exemplary embodiment—braced with an acoustic nonwoven 8. The loudspeaker covering panel 3, which is a metal screen in this exemplary embodiment, serves inter alia the purpose of protecting from damage the loudspeaker which is equipped therewith. The acoustic functionality of the loudspeaker is ensured by means of the grille-like or perforated configuration of the loudspeaker covering panel 3. By means of a suitable selection of the materials from which the loudspeaker covering panel 3 is manufactured, the visual appearance thereof can be configured in a targeted fashion.

The lighting device 4 has at least one lightguide 40 arranged between the carrier frame 2 and the loudspeaker cover 3 and extends in the circumferential direction of the carrier frame 2. In addition, the lighting device 4 comprises at least one lighting unit (not explicitly illustrated here) which preferably has at least one light emitting diode (LED) as lighting means. The lighting unit can be configured in such a way that it can emit light with a certain color. Alternatively, the lighting unit can also be embodied in such a way that it can emit light of different colors which can also be adjusted, for example, in a user-defined fashion. The lighting unit is arranged in such a way that during operation it can input light into a light input surface of the lightguide 40. The light can propagate in a known fashion through internal total reflections within the lightguide 40. In order to achieve more homogeneous illumination of the lightguide 40 in the circumferential direction, it is particularly advantageous if the lighting device 4 has two lighting units which are preferably arranged essentially opposite one another. Accordingly, the lightguide 40 has two light input surfaces through which the light emitted by the lighting units can be input into said lightguide 40. Uniform inputting of the light into the lightguide 40 preferably is provided. This means that the inputting of the light emitted by the two lighting units occurs, when viewed from the outside, either in the clockwise direction or in the counter-clockwise direction, but not in opposite directions.

As is apparent from FIG. 2, the loudspeaker covering panel 3 does not terminate flush with the carrier frame 2 around the edge side. In the circumferential direction of the carrier frame 2, a light exit opening 7 which runs around is formed between said carrier frame 2 and the loudspeaker covering panel 3. A portion of the light that is input into the lightguide 40 by the at least one lighting unit exits outward through a lateral surface of the lightguide 40 and is reflected by a reflector 5 of the lighting device 4, which reflector 5 extends in certain sections into the region of the light exit opening 7. The reflector 5 has a reflection surface 50 which, in the exemplary embodiment shown here, is shaped in a parabolic fashion and has a reflection coating which is preferably manufactured by means of an electroplating method. The reflection surface 50 has a focal point which is in the field of vision of the light exit opening 7. The light which is reflected at the reflection surface 50 of the reflector 5 therefore propagates at least partially into the surroundings and thereby produces accent illumination.

To achieve a softer light irradiation characteristic, the lighting device 4 also has in this exemplary embodiment a diffuser means 6 which extends in certain sections around the lightguide 40 and which can scatter diffusely the light passing through the latter. The diffuser 6 has a securing section 62 which is shaped in such a way that the lateral surface of the lightguide 40 bears in certain sections against the latter. The securing section 62 is preferably embodied in an integral fashion with the diffuser 6. An intermediate surface 9, which can be manufactured, for example, from an elastic polyethylene foam, is arranged between the lightguide 40 and an inner side of the loudspeaker covering panel 3. As a result, pretension is generated which can contribute to minimizing direct irradiation of the light. The intermediate surface 9 therefore forms in this region a lightproof cover which can effectively prevent visually disruptive direct exiting of the light through the loudspeaker covering panel 3.

The loudspeaker covering panel 3 and the carrier frame 2 are connected to one another in a materially joined fashion at least in certain sections. This materially joined connection can be obtained, for example, by welding or alternatively also by bonding. In the exemplary embodiment shown here, the loudspeaker covering panel 3 has on an inner side a number of connection projections 30, 31 which are shaped essentially in the manner of pins and which are inserted during mounting into corresponding receptacle openings 20 of the carrier frame 2, with the result that welding or optionally also bonding of the loudspeaker covering panel 3 to the carrier frame 2 can take place in these regions. The loudspeaker covering panel 3 can also be welded or bonded in a planer fashion at least in certain sections to the carrier frame 2.

Before the manufacture of the materially joined connection, the lightguide 40, the diffuser 6 and a securing section 51 of the reflector 5 are arranged between the loudspeaker covering panel 3 and the carrier frame 2. The manufacture of the materially joined connection provides a one-piece assembly which can be mounted as a premounted unit particularly easily in the recess in the passenger compartment trim of the motor vehicle. In order to attach the loudspeaker cover 1 in the recess, the carrier frame 2 preferably has a number of clip connectors (not illustrated explicitly here) for a frictionally locking attachment. The clip connection means permit releasable attachment of the loudspeaker cover 1 in the recess of the passenger compartment trim. Alternatively, the loudspeaker cover can also be attached in the recess in the passenger compartment trim by welding or bonding.

In this exemplary embodiment, the diffuser 6 has on an inner side facing the carrier frame 2 a number of pin-like connecting projections 60 which each extend through a plug-through opening in the securing section 51 of the reflector 5 and through a plug-through opening in the carrier frame 2. In the region of the connecting projections, additionally welding (optionally also bonding) can take place in order to increase the stability of the entire arrangement further.

Figure 3:
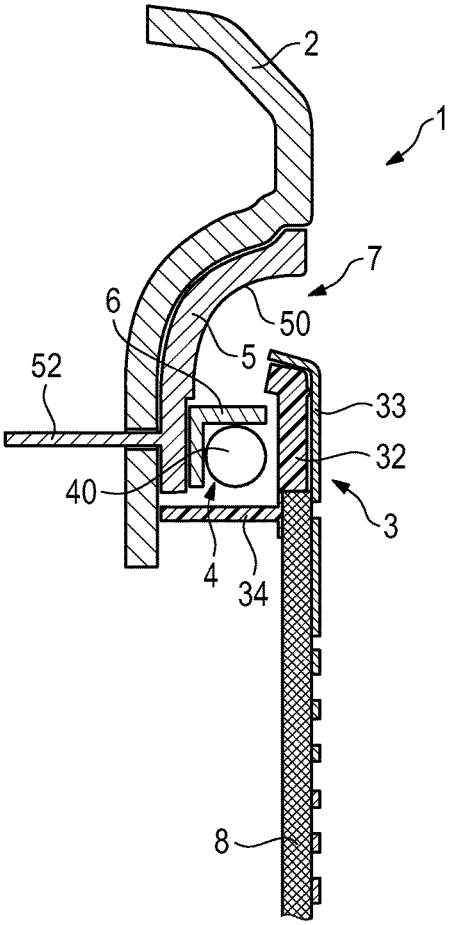
FIG. 3 shows an enlarged view, corresponding to the illustration according to FIG. 2, of a detail of a loudspeaker cover which is embodied according to a second exemplary embodiment of the present invention.

With reference to FIG. 3, a second exemplary embodiment of the loudspeaker cover 1 will be explained in more detail below. The basic design of the loudspeaker cover 1—in particular of the lighting device 4, of the reflector means 5 and of the diffuser means 6—corresponds essentially to that of the first exemplary embodiment, with the result that the differences will primarily be described below. The loudspeaker covering panel 3 has here a carrier 32 which is preferably manufactured from plastic and is braced with an acoustic nonwoven 8 in certain sections. A metal screen 33, which is embodied in an at least partially perforated fashion, is attached to an outer side of the carrier 32. The metal screen 33 therefore forms a visible side of the loudspeaker covering panel 3 and is preferably bonded to the carrier 32 at least in certain sections.

The loudspeaker covering panel 3 and the carrier frame 2 are in turn connected to one another in a materially joined fashion at least in certain sections. This materially joined connection can be obtained, for example, by welding or alternatively also by bonding. In the exemplary embodiment shown here, the loudspeaker covering panel 3 has on an inner side a connecting fin structure 34 which extends in the circumferential direction and can be embodied, for example, in such a way that during mounting it can be inserted into a number of depressions, corresponding thereto, in the carrier frame 2, with the result that in these regions welding or optionally also bonding of the loudspeaker covering panel 3 to the carrier frame 2 can take place.

As in the first embodiment, the lightguide 40, the diffuser 6 and the reflector 5 are arranged between the loudspeaker covering panel 3 and the carrier frame 2. In this embodiment, the reflector 5 has on an inner side facing the carrier frame 2 pin-shaped connecting projections 52 that extend through a plug-through opening in the carrier frame 2. In the region of the connecting projections 52, additional welding (optionally also bonding) can take place to increase the stability of the entire arrangement further.

Figure 4:
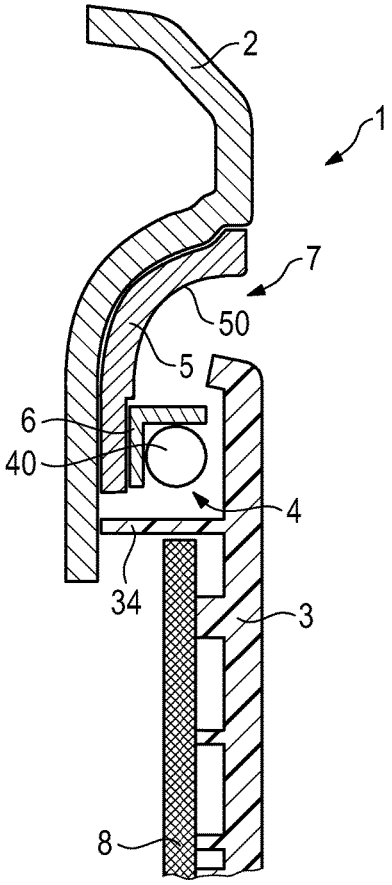
FIG. 4 shows an enlarged view, corresponding to the illustration according to FIG. 2, of a detail of a loudspeaker cover which is embodied according to a third exemplary embodiment of the present invention.

With reference to FIG. 4, a third exemplary embodiment of a loudspeaker cover 1 will be explained in more detail below. In contrast to the second exemplary embodiment, the loudspeaker covering panel 3 is embodied in one part from plastic. The loudspeaker covering panel 3 is braced with an acoustic nonwoven 8 at least in certain sections. In contrast to the third exemplary embodiment, the reflector means 5 does not have any additional connecting projections 52 on an inner side facing the carrier frame 2. Therefore, the plug-through openings in the carrier frame 2, through which leakage light can escape under certain circumstances, can also advantageously be dispensed with.

The diffuser 6 according to FIGS. 3 and 4, can also have at least one securing section that can be embodied like the securing section 62 of the diffuser 6 according to FIG. 2. Optionally, an additional securing section can be provided which extends at least in certain sections around the side, facing the carrier 32 or the loudspeaker covering panel 3, of the lateral surface of the lightguide 40 and bears against said side in certain sections.

In these embodiments, a scattered light cover for the at least one lighting means of the lighting device 4 is preferably provided to reduce scattered light effects.

The loudspeaker covers 1 described here have the advantage that they can be mounted very easily as a one-piece premounted assembly in a recess in a passenger compartment trim of a motor vehicle or else on a loudspeaker housing. Particular mounting advantages are produced if the loudspeaker cover 1 is attached in the recess in a frictionally locking fashion, in particular using clip connection means.

What is claimed is:

1. A loudspeaker cover, comprising:

a carrier frame having an outer periphery and a concavity inward of the outer periphery;

a sound-permeable loudspeaker covering panel attached to the carrier frame and having an outer periphery spaced radially inward of an outer periphery of the concavity in the carrier frame so that a light exit opening is formed between the outer periphery of the loudspeaker covering panel and the outer periphery of the concavity in the carrier frame;

a lighting device having at least one light guide and at least one lighting unit arranged in such a way that, during operation, light from the lighting unit is input into the light guide, the light guide being arranged in the concavity of the carrier frame and extending in a circumferential direction of the carrier frame at a position radially inward of the light exit opening and between the carrier frame and the loudspeaker covering panel; and a concave reflector in the concavity at a position radially out from the light guide so that at least a portion of the light exiting a lateral surface of the light guide is reflected by the reflector and propagates into the surroundings through the light exit opening, wherein a plurality of locations on the carrier frame are connected in a materially joined fashion to the loudspeaker covering panel.

2. The loudspeaker cover of claim 1, wherein the carrier frame is welded to the loudspeaker covering panel.

3. The loudspeaker cover of claim 1, wherein the carrier frame is bonded to the loudspeaker covering panel.

4. The loudspeaker cover of claim 1, wherein the carrier frame is shaped to be mounted on a loudspeaker housing or in a recess in a passenger compartment trim of a motor vehicle.

5. The loudspeaker cover of claim 4, wherein the outer periphery of the carrier frame is configured so that the carrier frame is locked frictionally in the recess in the passenger compartment trim.

6. The loudspeaker cover of claim 1, wherein the reflector has a reflection surface that extends into the light exit opening.

7. The loudspeaker cover of claim 1, wherein the lighting device has a diffuser that extends at least partly around the light guide at positions between the light guide and the light exit opening and that diffusely scatters the light exiting the lateral surface of the light guide.

8. The loudspeaker cover of claim 7, wherein the diffuser is connected in a materially joined fashion to the carrier frame.

9. The loudspeaker cover of claim 8, wherein the light guide is retained between the carrier frame, the loudspeaker covering panel and the diffuser.

10. The loudspeaker cover of claim 9, further comprising an intermediate member between the light guide and the loudspeaker covering panel for minimizing direct irradiation of flight from the light guide through the loudspeaker covering panel.

11. The loudspeaker cover of claim 8, wherein the carrier frame is formed with a plurality of plug-through openings, and the diffuser has a plurality of connecting projections extending through the plug-through openings in the carrier frame, the connecting projections of the diffuser being connected in a materially joined fashion to the carrier frame at the plug-through openings.

12. The loudspeaker cover of claim 1 wherein the carrier frame has a plurality of receptacle openings and the loudspeaker covering panel has a plurality up connection projections inserted respectively into the receptacle openings of the carrier frame, the connection projections of the loudspeaker covering' panel being connected in a materially joined fashion to the carrier frame at in the receptacle openings.

13. The loudspeaker cover of claim 1 wherein the carrier frame has a plurality of receptacle openings and the reflector has a plurality up connection projections inserted respectively into the receptacle openings of the carrier frame, the connection projections of the reflector being connected in a materially joined fashion to the carrier frame at in the receptacle openings.

14. A loudspeaker cover, comprising:

a carrier frame having an outer periphery and a concavity inward of the outer periphery;

a sound-permeable loudspeaker covering panel attached to the carrier frame and having an outer periphery spaced radially inward of an outer periphery of the concavity in the carrier frame so that a light exit opening is formed radially outward of the outer periphery of the loudspeaker covering panel and radially inward of the outer periphery of the concavity in the carrier frame;

a lighting device having at least one light guide and at least one lighting unit arranged in such a way that, during operation, light from the lighting unit is input into the light guide, the light guide being arranged in the concavity of the carrier frame and extending in a circumferential direction of the carrier frame at a position radially inward of the light exit opening and between the carrier frame and the loudspeaker covering panel;

a diffuser extending circumferentially around the light guide and inward of the light exit opening; and a concave reflector in the concavity at a position radially out from the diffuser so that at least a portion of the light exiting the diffuser is reflected by the reflector and propagates into the surroundings through the light exit opening, wherein a plurality of locations on the carrier frame are connected in a materially joined fashion to the loudspeaker covering panel.

15. The loudspeaker cover of claim 14, wherein the light guide is retained between the carrier frame, the loudspeaker covering panel and the diffuser.

16. The loudspeaker cover of claim 15, further comprising a wall circumferentially inward of the light guide and extending between the carrier frame and the loudspeaker covering panel.

* * * * *